United States Patent [19]

Hart

[11] 4,153,118

[45] May 8, 1979

[54] METHOD OF AND APPARATUS FOR PERFORATING BOREHOLES

[76] Inventor: Michael L. Hart, 2906 Maple Ave., Dallas, Tex. 75201

[21] Appl. No.: 781,991

[22] Filed: Mar. 28, 1977

[51] Int. Cl.[2] ..... E21B 43/116

[52] U.S. Cl. ..... 175/4.51; 166/55; 166/297

[58] Field of Search ..... 175/4.51, 4.52, 77, 175/81, 4.55; 166/55, 297

[56] References Cited

U.S. PATENT DOCUMENTS

| | | | |
|---|---|---|---|
| 2,952,319 | 9/1960 | Popham | 166/55 |
| 3,307,626 | 3/1967 | Bielstein | 166/55 X |
| 3,426,849 | 2/1969 | Brumble, Jr. | 175/4.51 X |
| 3,554,299 | 1/1971 | Sullivan | 175/4.55 |
| 3,707,195 | 12/1972 | Lanmon | 175/4.52 |

*Primary Examiner*—William Pate, III

*Attorney, Agent, or Firm*—Richards, Harris & Medlock

[57] ABSTRACT

A perforator apparatus includes an elongate body having a center of gravity and characterized by a longitudinal axis extending through the center of gravity. The body is supported at a point substantially laterally displaced from the axis having the center of gravity therein, so that the body of the perforator apparatus pivots into a predetermined orientation under the action of gravity when the apparatus is lowered into a nonvertically aligned borehole. The apparatus includes structure for discharging perforating charges in directions having a predetermined orientation relative to a line extending from the point of suspension through the axis having the center of gravity therein. By this means the directions of the perforating charges may be oriented relative to a thin portion of a cement structure extended between the borehole and a casing disposed therein.

4 Claims, 7 Drawing Figures

METHOD OF AND APPARATUS FOR PERFORATING BOREHOLES

BACKGROUND AND SUMMARY OF THE INVENTION

This invention relates to a method of and apparatus for perforating boreholes, and more particularly to a method of and apparatus for controlling the angular orientation of perforations made in boreholes.

In forming boreholes such as petroleum wells and the like, it is customary to install a casing in the borehole and to thereafter cement the casing in place. Subsequently the cemented casing is perforated to provide fluid communication with desired strata while simultaneously isolating other strata which may extend both above and below the desired strata.

Boreholes of this type are typically nominally vertical, and for many purposes may be considered as extending perpendicularly to the surface of the earth. Actually, however, boreholes varying as much as 5 degrees from vertical are within tolerance limits, and boreholes varying 6 degrees or more from vertical are quite common. When a casing is positioned in such non-vertically oriented borehole, the action of gravity causes the casing to be positioned more closely adjacent to the "low" side of the borehole, rather than being centered with respect to the borehole as is often assumed. This in turn means that the cement structure surrounding the casing is substantially thinner on the low side of the borehole than it is on the opposite side, and in some cases is non-existent.

In perforating such a borehole it is common practice to direct perforating charges in opposite directions along perpendicular axes, i.e. in four directions with respect to the perforating gun. It has been found that when this practice is carried out in non-vertically oriented boreholes, one of the perforating charges invariably penetrates the thin cement section surrounding the casing on the low side of the borehole. This can cause the cement structure to shatter considerably beyond the desired amount of perforation, whereupon the cement structure fails to properly isolate the desired strata from other strata extending both above and below the desired strata in the borehole, or if no cement exists, causes communication between strata.

Various apparatus has heretofore been provided for controlling the direction of operation of a perforating gun. In general, such apparatus has been intended for use in wells having multiple pipe strings extending through the casing so as to effect perforation of one of the pipe strings without causing perforation of the remaining pipe strings. Many such devices have used irregularly shaped pipe sections and/or camming systems in order to effect perforator orientation. One device utilized a gravity actuated switch to control perforator orientation by means of a servo motor. One characteristic of all the prior art well perforating apparatus has been complexity of design, leading to unnecessary expense in manufacture and use and unreliability and operation.

The present invention comprises a method of and apparatus for perforating wells which overcomes the foregoing and other problems long since associated with the prior art. In accordance with the broader aspects of the invention, a well perforating apparatus is suspended from a point which is laterally displaced from an axis extending through the center of gravity of the apparatus. Therefore, whenever the apparatus is extended into a borehole which does not extend absolutely vertically, the perforating apparatus rotates under the action of gravity to locate the center of gravity of the apparatus on the low side of the borehole with respect to the point at which the apparatus is suspended. By this means the orientation of perforating guns comprising the perforating apparatus is precisely controlled.

In accordance with more specific aspects of the invention, a casing extends through a borehole and is positioned to the low side thereof. The cement structure extending between the borehole and the casing therefore has a relatively thin or non-existent section adjacent the low side of the casing. By means of the present invention, the center of gravity of the perforator apparatus is oriented under the action of gravity toward the low side of the casing as the perforator apparatus is lowered into the borehole. Shaped charges or projectiles adapted to effect perforation of the casing and the surrounding cement structure are adapted for discharge from the perforator apparatus in predetermined directions, which directions are precisely controlled due to the orientation of the center of gravity out of the apparatus on the low side of the borehole.

The present invention may also be utilized in the controlled perforation of multiple pipe strings extending through the casing. Thus, assuming that the orientation of each pipe string relative to the remaining pipe strings in the casing is known, the fact that the center of gravity of the well perforator apparatus of the present invention is always located in a predetermined manner allows the perforation of each pipe string within the casing in a predetermined direction. By this means it is possible to assure the perforation of each selected pipe string while preventing perforation of the remaining pipe strings extending through the casing.

DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
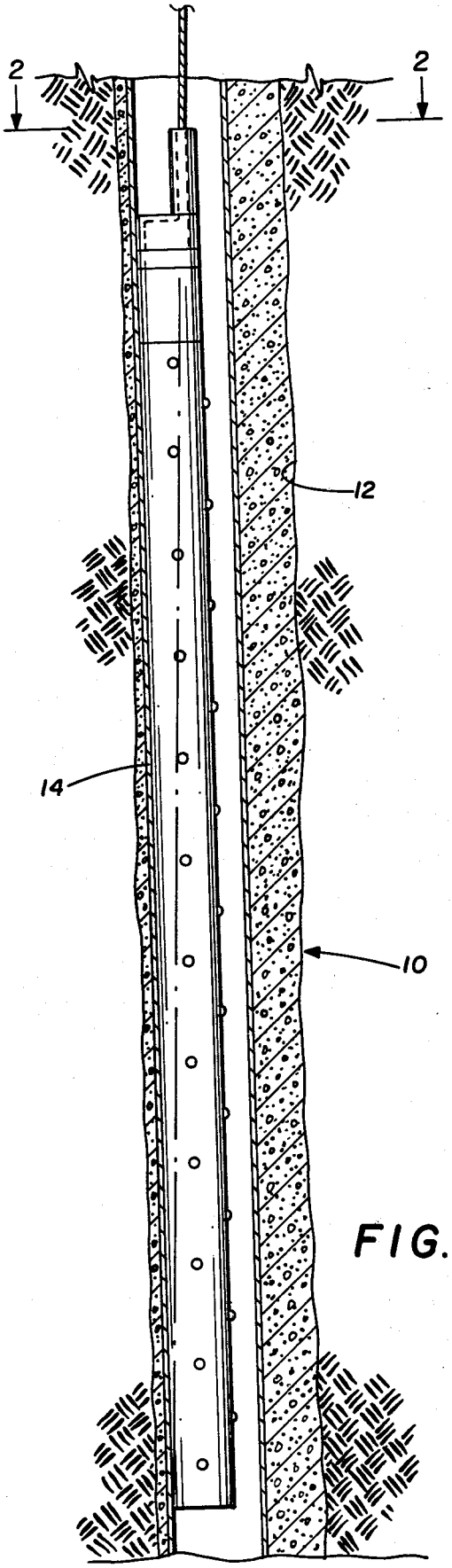
FIG. 1 is a vertical sectional view of a borehole showing the use of the present invention therein.
Figure 2:
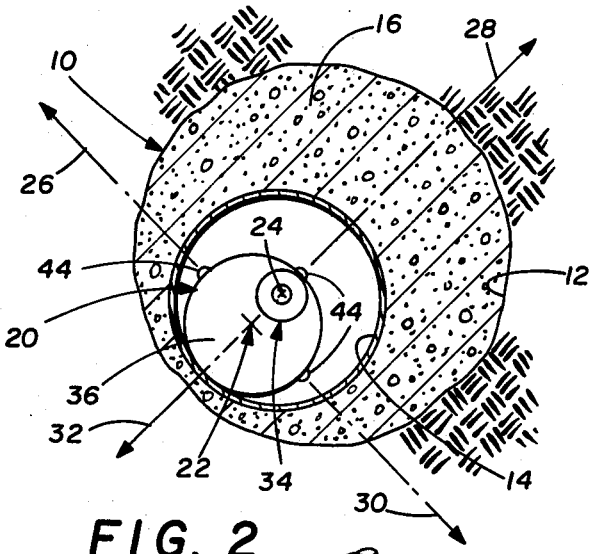
FIG. 2 is a sectional view taken generally along the line 2—2 in FIG. 1.

Referring now to the Drawings, and particularly to FIGS. 1 and 2 thereof, there is shown a borehole structure 10 of the type commonly used in forming petroleum wells and the like. The borehole structure 10 includes a borehole 12 which is formed in the earth by means of conventional drilling equipment. A casing 14 extends through the borehole 12. A cement structure 16 extends between the casing 14 and the borehole 12. The purpose of the cement 16 is to isolate the various strata of the earth through which the borehole structure 10 passes.

The borehole 12 is nominally vertical in orientation, and for many purposes may be considered as being oriented vertically. Actually, however, most boreholes are not vertically oriented, with a deviation of up to 5 degrees from vertical being within tolerance limits, and with deviations of 6 degrees or more being quite common in some petroleum wells and the like. Therefore, when the casing 14 is positioned within the borehole 12, the action of gravity causes the positioning of the casing 14 closer to the "low" side of the borehole 12, and with a substantial gap extending between the casing 14 and the opposite side of the borehole 12. When the borehole 12 is later cemented, this results in a relatively thin or non-existent cement section on the low side of the borehole 12, and a diametrically opposed relatively thick cement section.

The present invention comprises a well perforator apparatus 20 which is particularly adapted for use in boreholes. which extend non-vertically. The apparatus 20 is cylindrical in shape, and therefore has a longitudinal axis. In accordance with the embodiment of the invention illustrated in FIGS. 1, 2 and 3, the apparatus 20 has a center of gravity which is located at a point 22 substantially aligned with the longitudinal axis of the apparatus. However, the apparatus 20 is suspended in the borehole at a point 24 which is laterally offset from the axis extending through the center of gravity 22. Therefore, as the well perforator apparatus 20 is lowered into the borehole, the action of gravity pivots the apparatus 20 about the point of connection 24 so that the center of gravity 22 is oriented toward the low side of the borehole.

The orientation of the well perforator apparatus 20 relative to the low side of the borehole 12 is therefore known. It is therefore possible to direct well perforating shaped charges or projectiles out of the apparatus 20 in such direction that the low side of the borehole and the casing 14 is not perforated. For example, the particular embodiment of the invention illustrated in FIG. 2 is adapted to direct shape charges in the directions 26, 28 and 30, which directions extend through the thicker portions of the cement structure 16 extending between the borehole 12 and the casing 14, but do not extend through the thin section of the cement structure 16 extending between the low side of the borehole 12 and the casing 14. That is, each of the directions 26, 28 and 30 is substantially non-aligned with a direction characterized by the line 32 starting at the point 24 comprising the point of suspension of the apparatus 20 and extending therefrom through the point 24 having the center of gravity of the apparatus 20 therein and through the thin portion of the cement structure 16. By this means the problem of excessive shattering of the thin portion of the cement structure or of perforating through a section of no cement is eliminated.

Figure 3:
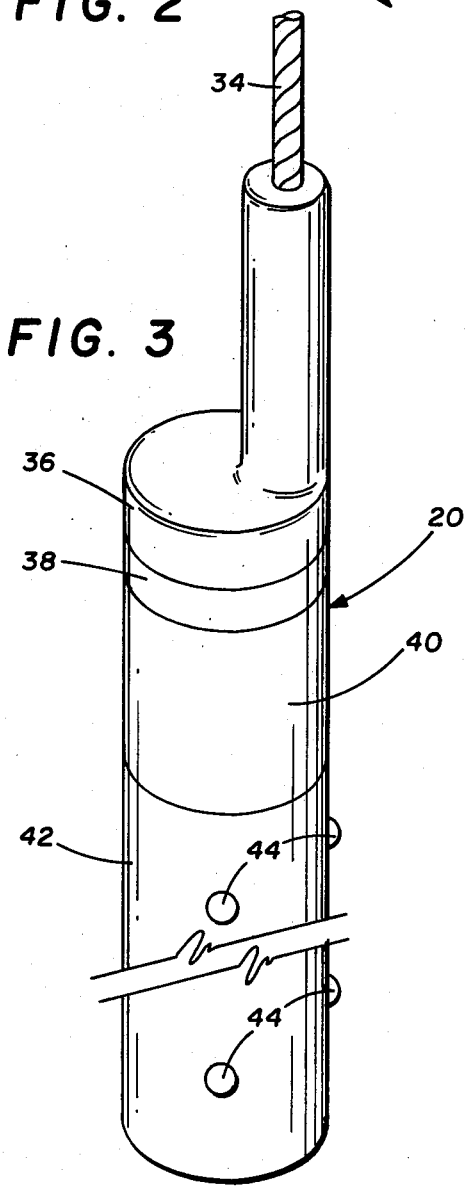
FIG. 3 is a perspective view of a well perforator apparatus incorporating the first embodiment of the invention.

Referring now to FIG. 3, the structure of the well perforator apparatus 20 is shown in greater detail. The apparatus 20 is suspended from a cable 34. The cable 34 provides mechanical support for the apparatus 20, and also comprises an electrical lead, whereby electrical signals are directed to and/or received from the apparatus 20. The cable 34 must therefore either comprise an electrically conductive material or have an electrically conductive material contained therein whereby electrical signals may be transmitted to and/or received from the apparatus 20 from the surface of the earth.

The cable 34 extends to a cap 36 which is mechanically connected to the remainder of the apparatus 20 by means of a threaded connection. The cap 36 functions to connect the cable 34 to the remainder of the apparatus 20 at a point which is substantially offset from a longitudinal axis extending through the center of gravity of the apparatus 20.

The cap 36 extends to an adapter section 38. The adapter section 38 serves to mechanically connect the cap 36 to the remaining components of the apparatus 20, and to permit precise orientation between the cap 36 and the perforating components of the apparatus 20. Additionally, the adapter section 38 may include means responsive to electrical signals received through the cable 34 for effecting operation of other components of the apparatus 20 and/or apparatus for receiving input signals from other components of the apparatus 20 and for transmitting such signals through the surface of the earth through the electrical cable 34.

The apparatus 20 may include a casing collar locator 40. It will be understood that the casing 14 of the borehole structure 10 does not typically comprise a continuous member, but instead comprises a series of casing sections which are connected end to end. Typically, the casing sections are connected by means of collars which are threadedly connected to the opposite ends of adjacent casing sections. Such casing collars are identifiable by any of various commercially available casing collar locator apparatus, any one of which may be utilized in the practice of the present invention. It will thus be understood that as the apparatus 20 is lowered into the borehole structure 10, the casing collar locator 40 generates a signal whenever a casing collar is located in the casing 14. Such signal is transmitted to the surface of the earth through the cable 34, whereby it is possible to maintain continuous control over the exact depth to which the apparatus 20 has been lowered in the borehole structure 10.

The apparatus 20 further includes a perforator section 42. Perforator section 42 includes a plurality of shaped charges or projectiles which are adapted for actuation from within the apparatus 20, and upon actuation to travel outwardly from the perforator section 42 of the apparatus 20 in predetermined directions, such as the directions 26, 28, and 30 as shown in FIG. 2. During such travel the charges or projectiles 44 engage and penetrate not only the casing 14 but also the cement structure 16 extending between the casing 14 and the borehole 12. By this means the charges or projectiles 44 of the perforator section 42 of the apparatus 20 provide fluid communication between the desired strata in the earth and the interior of the casing 14.

Any of the various commercially available shaped charges or well perforating projectiles may be utilized as the charges or projectiles 44 of the present invention. Likewise, any of the various commercially available actuating circuits may be utilized within the perforator section 42 or elsewhere within the apparatus 20 to effect actuation of the charges or projectiles 44. It should be noted in this regard that whereas for clarity of illustration the charges or projectiles 44 have been shown in the Drawings as including portions projecting outwardly beyond the outer surface of the section 42, such outwardly projecting portions are not necessary to the successful practice of the invention.

Figure 4:
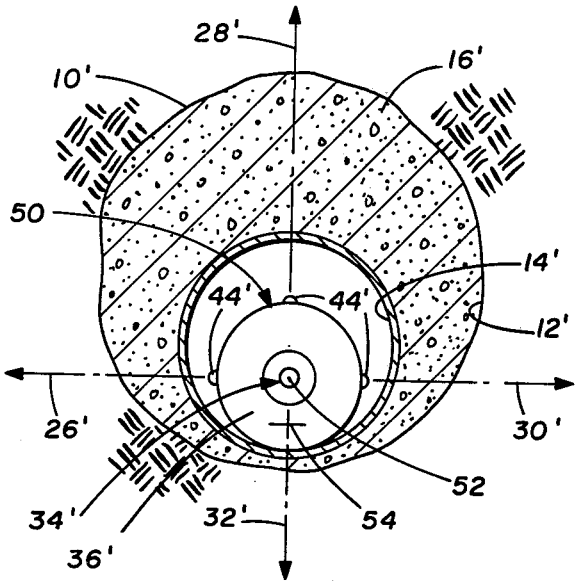
FIG. 4 is a perspective view of a well perforator apparatus incorporating a second embodiment of the invention.

Referring now to FIG. 4, there is shown a perforator apparatus 50 incorporating a second embodiment of the invention. The perforator apparatus 50 incorporates numerous component parts which are substantially identical to the component parts of the perforator apparatus 20 illustrated in FIGS. 1, 2 and 3. Such identical component parts are designated in FIG. 4 with the same reference numerals utilized hereinabove in conjunction with the description of the perforator apparatus 20, but are differentiated therefrom by means of a prime (') designation.

The perforator apparatus 50 is substantially the same as the perforator apparatus 20 except that the cable 34' supports the apparatus 50 along the longitudinal center line 52 thereof. The apparatus 50 has a center of gravity located on an axis 54 which is substantially laterally offset from the longitudinal center line 52. This may be accomplished either by positioning all of the component parts of the apparatus 50 having substantial mass on one side thereof, or by providing the apparatus 50 with structure such as lead or cast iron on one side thereof, or both. Regardless of the means utilized to position the center of gravity of the apparatus 50 on the axis 54, the net result is that when the apparatus 50 is lowered into a borehole which is oriented non-vertically, it pivots under the action of gravity such that a line starting at the point of support of the apparatus 50 by means of the cable 34' and extending therefrom through the axis 54 having the center of gravity therein passes through the lowermost portion of the borehole 12', and therefore through the thinnest portion of the cement structure 16'. It will thus be understood that the perforator apparatus 50 functions in exactly the same manner as the perforator apparatus 20 described hereinabove in connection with the first embodiment of the invention.

Figure 5:
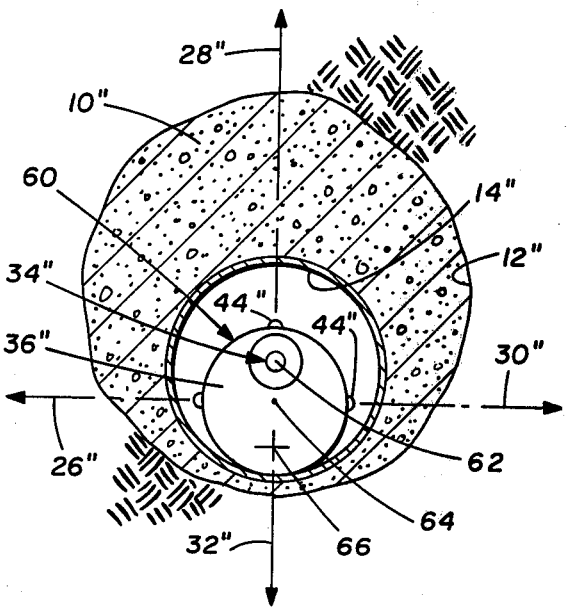
FIG. 5 is a sectional view similar to FIG. 2 illustrating the use of the second embodiment of the invention.

Referring to FIG. 5, there is shown a perforator apparatus 60 incorporating a third embodiment of the invention. The perforator apparatus 60 includes numerous component parts which are substantially identical to component parts of the perforator apparatus 20 shown in FIGS. 1, 2 and 3. Such identical component parts are designated in FIG. 5 with the same reference numerals utilized hereinabove in connection with the description of the perforator apparatus 20, but are differentiated therefrom by means of a double prime (") designation.

The primary differentiation between the perforator apparatus 60 and the apparatus comprising the first and second embodiments of the invention involves the fact that the cable 34" supports the apparatus 60 at a point 62 which is substantially displaced from the central axis 64 of the apparatus 60. Moreover, the center of gravity of the apparatus 60 is aligned with an axis 66 which is also substantially displaced from the central axis 64. Thus, the apparatus 60 functions in the same manner as the apparatus 20 and 50 such that as it is lowered into a borehole which is non-vertically oriented, it rotates under the action of gravity such that a line 32" extending from the point of support 62 through the axis 66 having the center of gravity therein passes through the lowest point of the borehole structure 10", and hence through the thinnest portion of the cement structure 16" extending between the borehole 10" and the casing 14".

Figure 6:
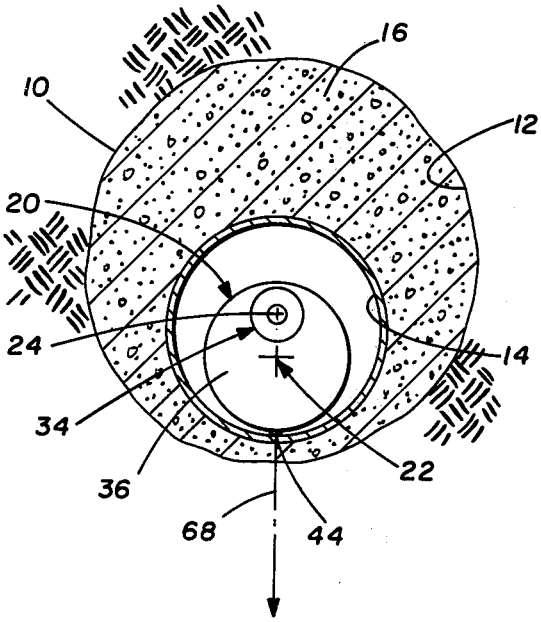
FIG. 6 is a sectional view similar to FIG. 2 illustrating an alternative utilization of well perforator apparatus incorporating the invention.

FIG. 6 illustrates an alternative utilization of the perforator apparatus 20 shown in FIGS. 1, 2 and 3 and described hereinabove in connection herewith, it being understood that the embodiments of the invention shown in FIGS. 4 and 5 are equally adapted to the utilization thereof shown in FIG. 6. The invention has heretofore been described as advantageous primarily in that by means thereof it is possible to eliminate the possibility of directing a perforating charge through the thin portion of the cement structure extending between the borehole 12 and the casing 14 which is characteristically positioned at the low side of the borehole 12. By this means any possible shattering of the thin portion of the cement structure is eliminated, whereby the desired separation between the various strata which are penetrated by the borehole 12 is maintained.

However, in certain instances it may be considered desirable to direct a perforating charge through the thin portion of the cement structure. In such instances the charge or projectile is directed as illustrated in FIG. 6, that is, along a line 68 which is coincident with the direction 32 as shown in FIG. 2. The fact that the charge or projectile will be directed as desired is assured due to the fact that the perforator apparatus 20 will automatically align itself in a manner illustrated in FIG. 6 as it is lowered into a non-vertically oriented borehole. Again, it will be understood that the perforator apparatus 50 shown in FIG. 4 or the perforator apparatus 60 shown in FIG. 5 may be utilized equally as well as the perforator apparatus 22 to direct a charge or projectile along the line 68 as shown in FIG. 6, if desired.

Figure 7:
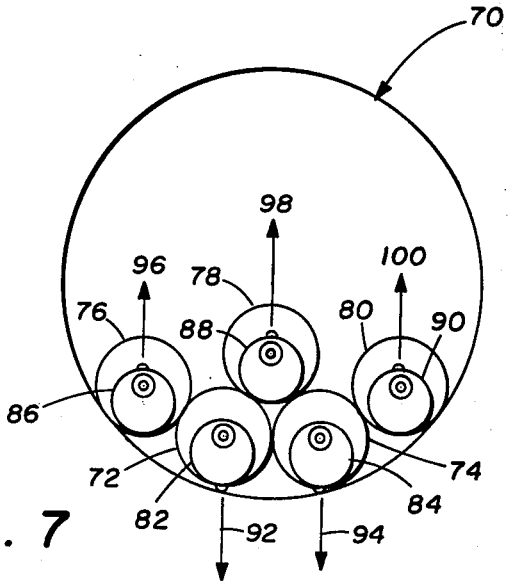
FIG. 7 is a view similar to FIG. 2 showing the use of the invention for selective perforation of multiple pipe strings extending through a casing.

FIG. 7 illustrates the use of the invention in conjunction with casings having multiple pipe strings therein. Thus, a large diameter casing 70 has a plurality of pipe strings 72, 74, 76, 78 and 80 extending therethrough. As is usual in the case of casings having multiple pipe strings extending therethrough, it is necessary to provide means for selectively perforating the individual pipe strings 72, 74, 76, 78 and 80 extending through the casing 70 while assuring that the remaining pipe strings are not perforated.

It has been determined that when multiple pipe strings are directed into a casing having a non-vertical orientation, the pipe strings will arrange themselves in accordance with a particular pattern. Thus, the first pipe string which is positioned in the casing will respond to the action of gravity to position itself adjacent to the low side of the casing, for example, the position occupied by the pipe strings 72 of FIG. 7. The next pipe string to be positioned within the casing will then position itself under the action of gravity in an adjacent position, in this case the position of the pipe string 74. The next three pipe strings will then position themselves under the action of gravity in the positions represented by the pipe strings 76, 78 and 80 of FIG. 7, with the typical sequence being first one of the two outside positions, then the center position, then the remaining outside position.

In accordance with the present invention, it is possible to perforate each of the pipe strings comprising such an arrangement while simultaneously assuring that the remaining pipe strings will not be perforated. Thus, in FIG. 7 a perforating apparatus 82 incorporating the present invention is positioned within the pipe string 72, a perforating apparatus 84 is positioned within the pipe string 74, a perforating apparatus 86 is positioned within the pipe string 76, a perforating apparatus 88 is positioned within the pipe string 78 and a perforating apparatus 90 is positioned within the pipe string 80. Since the pipe strings 72 and 74 are known to be positioned adjacent the low side of the casing 70, the perforating apparatus 82 and 84 are adapted to direct charges or projectiles in accordance with the directions 92 and 94, respectively. Likewise, since the pipe strings 76, 78 and 80 are known to occupy positions located inwardly from the pipe strings 72 and 74, the perforating apparatus 86, 88 and 90 are adapted to direct charges or projectiles in accordance with the directions 96, 98 and 100, respectively. By this means it is assured that the charge or projectile that perforates a particular pipe string will not perforate any of the remaining pipe strings.

From the foregoing, it will be apparent that the present invention incorporates numerous advantages over the prior art. Thus, by means of the invention, the direction of operation of perforating charges or projectiles may be accurately controlled, but without the necessity of providing any type of locating structure, such as camming structure, specially shaped casing or tubing sections, etc. Another advantage deriving from the use of the invention involves the fact that by means thereof, it is possible to control the direction of operation of perforating charges or projectiles such that a thin cement section extending between the borehole and a casing section is not shattered. Still another advantage deriving from the use of the invention involves the fact that by means thereof it is possible to control the direction of perforating charges or projectiles such that a selected tubing extending through a casing is perforated without perforating other tubings extending through the same casing. Other advantages deriving from the invention will immediately suggest themselves to those skilled in the art.

Although particular embodiments of the invention have been illustrated in the accompanying Drawings and described in the foregoing Detailed Description, it will be understood that the invention is not limited to the embodiments disclosed, but is capable of numerous rearrangements, modifications, substitutions of parts and elements without departing from the spirit of the invention.

What is claimed is:

1. A method of perforating non-vertically oriented boreholes comprising:

suspending a well perforator apparatus from a point substantially laterally displaced from an axis extending through the center of gravity of the well perforator apparatus;

lowering the thus suspended perforator apparatus into the borehole to be perforated so that the center of gravity of the well perforator apparatus is aligned with the low side of the borehole under the action of gravity;

actuating the thus positioned well perforating apparatus to discharge a perforating charge in a predetermined direction with respect to the alignment of the center of gravity of the well perforating apparatus with the low side of the borehole;

the well perforator apparatus having a central axis;

the center of gravity of the well perforator apparatus being located on an axis substantially laterally displaced from the central axis; and the suspending step being carried out by suspending the well perforator apparatus from a point substantially aligned with the central axis.

2. A method of perforating non-vertically oriented boreholes comprising:

suspending a well perforator apparatus from a point substantially laterally displaced from an axis extending through the center of gravity of the well perforator apparatus;

said well perforator apparatus having a central axis, with the center of gravity of the apparatus being substantially laterally displaced from the central axis, and wherein the suspending step is carried out by suspending the apparatus from a point substantially laterally displaced from the central axis;

lowering the thus suspended perforator apparatus into the borehole to be perforated so that the center of gravity of the well perforator apparatus is aligned with the low side of the borehole under the action of gravity operating directly on the well perforator apparatus to effect pivotal movement of the axis extending through the center of gravity of the well perforator apparatus about an axis extending through the point of suspension thereof; and actuating the thus positioned well perforating apparatus to discharge a perforating charge in a predetermined direction with respect to the alignment of the center of gravity of the well perforating apparatus with the low side of the borehole.

3. A well perforating apparatus comprising: an elongated body having a center of gravity and characterized by a longitudinal axis extending through the center of gravity;

means for suspending the body from a point substantially laterally displaced from the axis extending through the center of gravity so that the body is oriented under the action of gravity with the center of gravity thereof toward the low side of a non-vertically oriented borehole;

means for discharging at least one well perforating charge from the body in a predetermined direction with respect to the center of gravity and the point of suspension thereof;

the body having a central axis;

the center of gravity being situated on an axis substantially laterally displaced from the central axis; and the body being suspended from a point substantially aligned with the central axis.

4. A well perforating apparatus comprising:

an elongated body having a center of gravity and characterized by a longitudinal axis extending through the center of gravity;

means for suspending the body from a point substantially laterally displaced from the axis extending through the center of gravity so that the body is oriented under the action of gravity acting directly on the elongated body to effect pivotal movement of the axis extending through the center of gravity of the elongated body about an axis extending through the point of suspension of the elongated body and thereby positioning the center of gravity thereof toward the low side of a non-vertically oriented borehole;

said body having a central axis, with the center of gravity thereof being situated on an axis substantially laterally displaced from the central axis, and wherein the body is suspended from a point substantially and laterally displaced on a central axis; and means for discharging at least one well perforating charge from the body in a predetermined direction with respect to the center of gravity and the point of suspension thereof.

* * * * *